United States Patent [19]

Davoud et al.

[11] 3,996,745

[45] Dec. 14, 1976

[54] STIRLING CYCLE TYPE ENGINE AND METHOD OF OPERATION

[75] Inventors: John Gordon Davoud; Jerry Allen Burke, both of Richmond, Va.

[73] Assignee: D-Cycle Associates, Richmond, Va.

[22] Filed: July 15, 1975

[21] Appl. No.: 596,165

[52] U.S. Cl. ..... 60/517; 60/670; 60/688

[51] Int. Cl.[2] ..... F02G 1/04

[58] Field of Search ..... 60/516, 517, 525, 526, 60/651, 671, 670, 685, 688

[56] References Cited

UNITED STATES PATENTS

| | | | |
|---|---|---|---|
| 3,006,146 | 10/1961 | Jackson | 60/674 X |
| 3,490,234 | 1/1970 | Lea | 60/653 X |
| 3,772,883 | 11/1973 | Davoud et al. | 60/653 |
| 3,858,395 | 1/1975 | Davoud et al. | 60/689 X |

*Primary Examiner*—Allen M. Ostrager
*Attorney, Agent, or Firm*—Harold L. Stowell

[57] ABSTRACT

An improved Stirling cycle type engine is provided wherein the working fluid is a condensible fluid such as steam and a portion of the steam is condensed prior to the introduction of the steam into the cold cylinder zone. Before and/or during compression of the steam in the cold cylinder zone, water is injected in an amount equal to, greater than or less than the amount condensed.

7 Claims, 16 Drawing Figures

STIRLING CYCLE TYPE ENGINE AND METHOD OF OPERATION

BACKGROUND OF THE INVENTION

1. Field of the Invention

The Stirling cycle has received attention since its invention early in the nineteenth century. For various reasons it has not achieved commercial success; but because of its high theoretical efficiency and inherently low pollution, it is currently the subject of a considerable research and development program directed primarily towards automotive use.

In modern Stirling technology a number of factors have arisen which have lead to continuing and formidable problems, a number of which have proved to be intractable in the practical sense.

Some of these problems are:

1. Power output is changed by changing the pressure of the working fluid; and this leads to a complex system for withdrawing working substance from the engine, and putting it back in almost instantaneously.

2. Almost all the heat loss is by direct cooling of the so-called "cold space" of the engine, which leads to difficult design problems.

3. The use of a light gaseous working substance raises problems of explosion (hydrogen), loss through high volatility, and in the case of helium, availability and cost.

4. The most difficult problem has to do with heat transfer, that is, getting the heat into the working substance, and to attaining satisfactory efficiency.

A type of Stirling engine presently the focus of much attention is the valveless type. It is not a true Stirling engine. It is better described as a pseudo-Stirling engine; and in it the admirable principle of the true Stirling engine (constant temperature expansion and constant temperature compression at a much lower temperature) has been sacrificed for mechanical simplicity. The engine has no valves controlling the expansion and compression in the cylinder. Each cylinder head is connected with the base of the next cylinder through a heat exchanger so that the pressure in the "hot space" of one cylinder and the "cold space" of the next cylinder to which it is connected must always be the same but is changing constantly.

The ideal efficiency of the true Stirling engine is $(T_2 - T_1)/T_2$ where $T_2$ is temperature of expanding gas or vapor; $T_1$ is temperature during compression (in absolute degrees). This is the maximum or "Carnot" efficiency of a heat engine working between the temperature limits $T_2$ and $T_1$.

A true Stirling engine receives heat only during expansion. In a reciprocating engine this is usually done by heating the cylinder.

In the valveless type of Stirling engine, some heat is put into the working substance while it is expanding, but most is put in before expansion when the working substance is passing from the heat exchanger to the "hot space" above the piston. Thus, the engine actually carries out expansion somewhere between isothermal and isentropic; similarly for compression in the "cold space" below the piston.

A tube bundle can be used in both hot and cold spaces to increase heat transfer surface; but this cannot affect heat transfer during expansion or compression — only ensure that the gas is at or close to maximum temperature before expansion, and at minimum temperature before compression.

Thus, the "pseudo" Stirling engine has, by its nature, to depart considerably from theoretical Stirling efficiency.

To minimize this effect, the valveless Stirling engine employs very high temperature on the "hot side" of the engine. Heat input to the working substance is effected by gaseous combustion products applied directly to the expansion cylinders. However, heat transfer at the hot gas-metal interface is always relatively poor. The combination of high temperature plus the oxidizing medium provided by the combustion gases require the use of exotic and expensive heat resistant alloys with large nickel-chromium content.

SUMMARY OF THE INVENTION

Those and other disadvantages of the gaseous Stirling engine are anticipated and either eliminated or substantially reduced by using a condensing vapor such as steam for the working substance and by a number of innovative steps to be described hereinafter. The following description of a vapor Stirling engine takes as an example the valveless so-called Rinia type of reciprocating engine using pistons and cylinders. However, the system would be equally effective with the classical displacer piston-power piston type of Stirling engine as well as rotary Stirling engines.

The invention may be generally defined as a method of operating a Stirling cycle type engine comprising the steps:

A. directing a heated heat exchange fluid externally about the hot end of a cylinder of a Stirling cycle type engine and in indirect heat exchange with a condensible working fluid;

B. directing the heated vapor of the working fluid from the hot cylinder through a heat exchanger;

C. condensing a portion of the vapor after it has passed through the heat exchanger;

D. directing the remaining portion of the vapor to the cold cylinder space of the Stirling cycle type engine; and E. before and during compression of the vapor in the cold cylinder space, injecting a liquid of the working fluid in an amount equal to, greater than or Less than the portion condensed in step C.

BRIEF DESCRIPTION OF THE DRAWINGS

The invention will be more particularly described in reference to the accompanying drawings wherein.

DESCRIPTION OF PREFERRED EMBODIMENTS OF THE INVENTION

Figure 1:
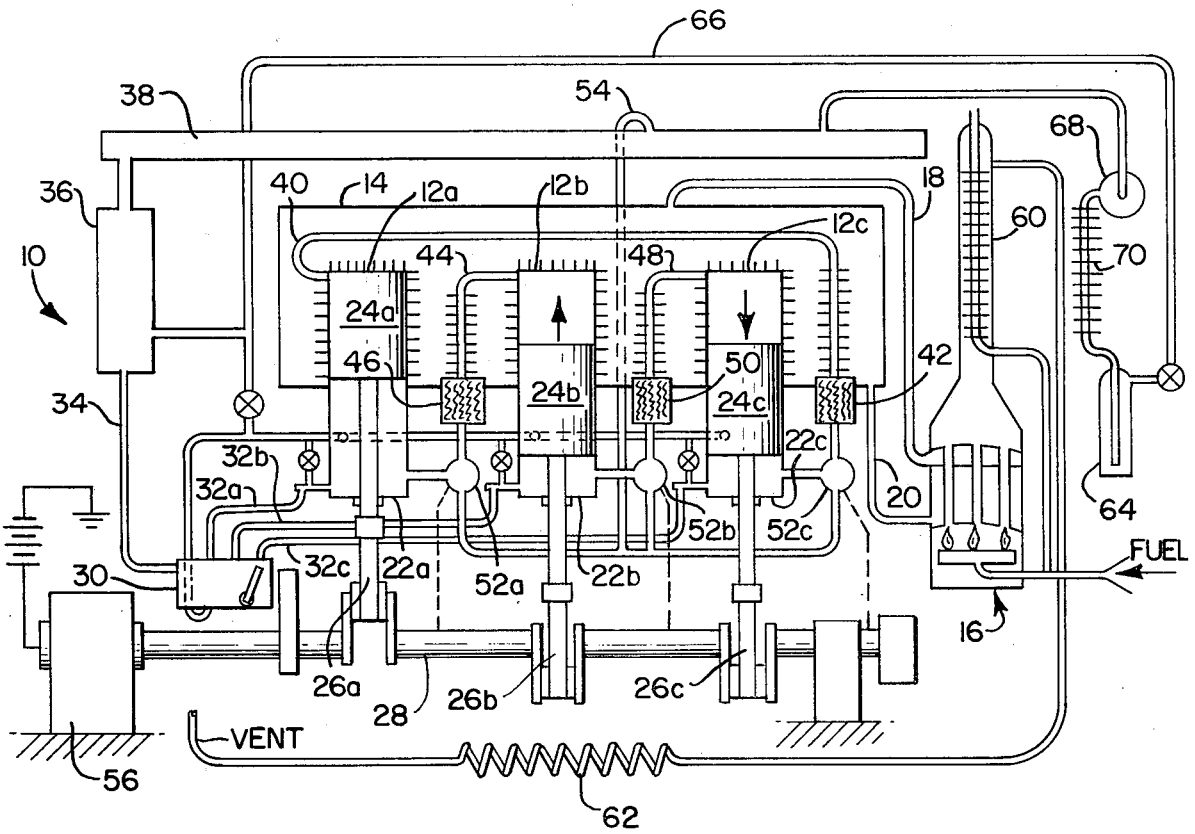
FIG. 1 is a diagrammatic view of a condensible fluid Sterling cycle type engine suitable for carrying out the present invention.

Referring to FIG. 1 of the drawing, diagrammatically illustrating a Rinia type Stirling engine generally designated 10, the engine has three cylinders 12*a*, 12*b* and 12*c*, the hot ends of which are enclosed by a common jacket 14. The portions of the cylinder 12*a*, 12*b* and 12*c* within the jacket 14 may be finned as illustrated to improve the heat exchange between a heat exchange medium contained within the jacket.

The heat exchange medium is heated to a high temperature by an external combustion heater generally designated 16. The heated fluid passes through the conduit 18 to the interior of the jacket 14 and the fluid returns to the heater from the jacket via conduit 20. Each of the cylinders 12*a*, 12*b* and 12*c* has a cold end 22*a*, 22*b* and 22*c* and each cylinder is fitted with a piston 24*a*, 24*b* and 24*c*. The pistons are connected by connecting rods 26*a*, 26*b* and 26*c* to a common crank shaft 28 via conventional cranks.

The crank shaft 28 drives a liquid injection pump 30 connected to injection orifices in each of the cold spaces of each of the cylinders via conduits 32*a*, 32*b* and 32*c* and the pump derives fluid via conduit 34 from condensate hot well 36 connected to the condenser 38.

The working fluid is heated to the vapor state within the housing 14 via conduit 40 which connects the upper end of the hot space of cylinder 12*a* to heat exchanger 42; conduit 44 which connects the upper end of the hot space of cylinder 12*b* to heat exchanger 46 and conduit 48 which connects the upper end of cylinder 12*c* to heat exchanger 50. The cold end of the heat exchangers 42, 46 and 50 are connected to mechanical valves 52*a*, 52*b* and 52*c*. The regulating valves are mechanically linked to the crank shaft 28 as illustrated. Each of the mechanical valves 52*a*, 52*b* and 52*c* is connected to the cold space of a cylinder 22*a*, 22*b* or 22*c* and to the condenser 38 via conduit 54 as illustrated.

The system also includes a generator 56, a heat saving device 60 connected to crank case heater 62 and a system whereby ammonia contained in ammonia flask 64 may be circulated into the working fluid via line 66 so that when the engine is not in operation the ammonia acts as an antifreeze and when the water is heated the ammonia gas is recompressed by compressor 68 and condensed by condenser 70 for restorage in ammonia flask 64.

The three-cylinder engine 10 is used to increase the expansion ratio of the cycle. The characteristics of such valveless Rinia system require fairly complex calculation-ideally with the aid of a computer — to determine the expansion ratio, and work out per revolution. However, a fair approximation can be made using a diagram showing piston displacement at consecutive crank intervals, of say, 15° making due allowance for ratio of the length of the connecting rod to the stroke.

Figure 2A:
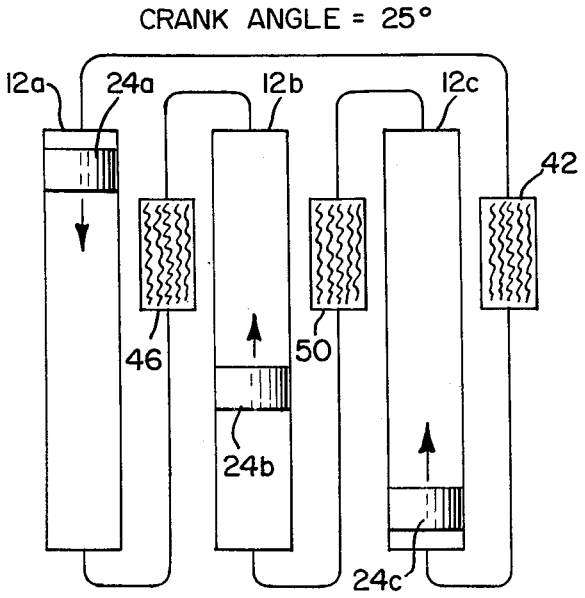
FIG. 2*a* diagrammatically illustrates a three-cylinder Rinia type engine with the pistons illustrated in a minimum volume position at a crank angle of 25°.
Figure 2B:
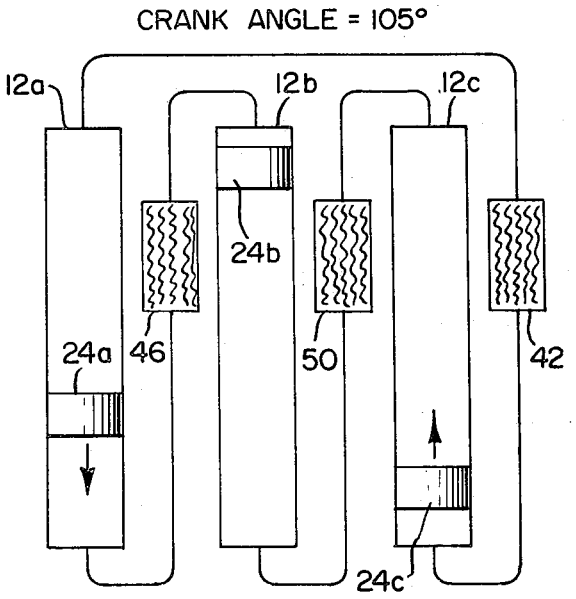
FIG. 2*b* diagrammatically illustrates a three-cylinder Rinia type engine with the pistons illustrated in a maximum volume position at a crank angle of 105°.

With such three cylinder configuration, the volume between pistons is at a minimum at a crank angle of about 25°, FIG. 2*a;* and at a maximum at a crank angle of about 105°, FIG. 2*b;* the ratio of maximum to minimum swept volume being about 16:1.

Unlike the Stirling engine with gaseous working fluid, the vapor Stirling engine of the invention requires a fairly low minimum pressure to achieve a low temperature for heat rejection, which is in this case the condensing temperature for steam.

A precise calculation of the power output from an engine of this type requires knowledge of unswept volume (interconnecting tubes and heat exchangers) between the cylinders. The expansion ratio is fixed. Hence, for a given engine speed, power is effectively changed by changing the quantity of steam in the system, which is very easily and rapidly done in the condensing vapor engine by changing rate of water injection.

To allow efficient operation at high ambient temperatures, a minimum condensing pressure of 10 pisa at equilibrium temperature (193.2° F) is a defining parameter. A four-fold increase in mass of working fluid would increase the power about four times while raising the condensing pressure to about 40 psia. The maximum working pressure would be ideally about 40 × 16 or 640 psia (assuming true isothermal expansion and neglecting unswept volume).

An approximate calculation as set forth in Example 1 indicates that a three-cylinder engine of the type shown could produce about 1 h.p. per cubic inch of swept volume, assuming 0.9 expansion and compression efficiency, 12% friction losses, and expansion at 1000° F.

The vapor Stirling engine will have a larger swept volume than one using a permanent gas because it has to operate over a lower pressure range as set forth. This has certain advantages. The increased heating surface and decreased metal thickness which result increase the heat transfer rate to the working medium while it is expanding, and together with the proposed use of a condensing vapor heat transfer medium will result in a closer approximation to ideal isothermal expansion.

REGENERATIVE HEAT EXCHANGERS

High efficiency regenerative heat exchangers 42, 46 and 50 for the engine have already been developed and are well known. The cycle of the invention is based in part on compression of wet steam to a point at or close to the saturated vapor line; thus, the cold end of the regenerator will see saturated or very nearly saturated vapor and "blinding" of the exchanger will not be a problem.

REMOVAL OF STEAM FROM HOT SPACE TO CONDENSER

Figure 3A:
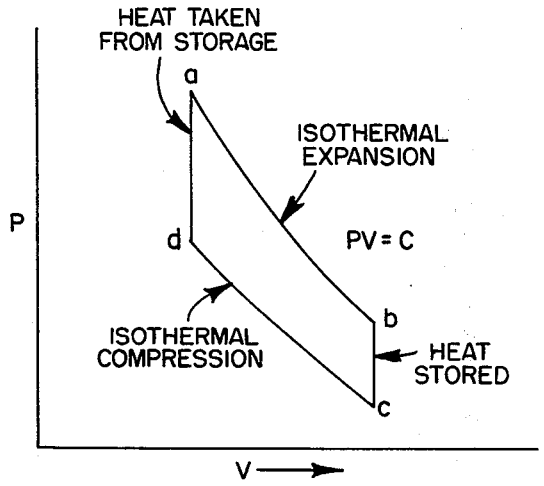
FIGS. 3*a* and 3*b* are pressure-volume and temperature-entropy diagrams for an ideal Stirling cycle.
Figure 3B:
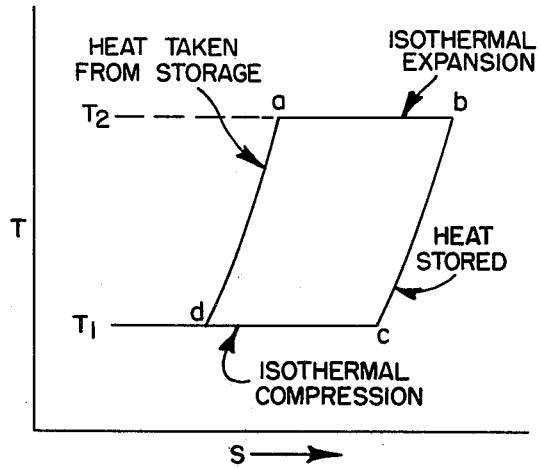
Figure 3C:
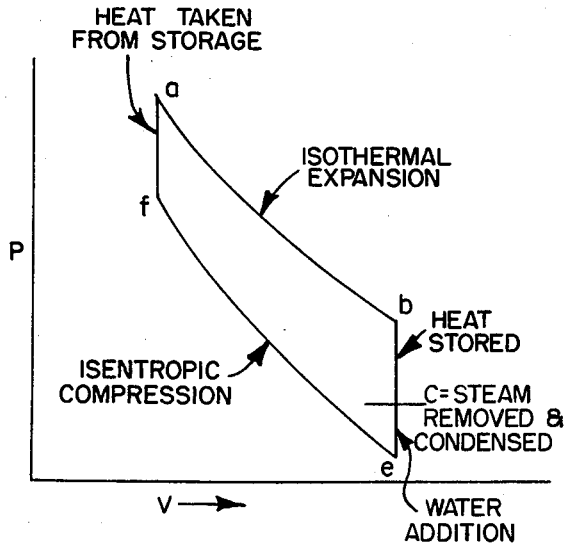
FIGS. 3*c* and 3*d* are similar diagrams for the Stirling cycle of the present invention employing as the working fluid steam.
Figure 3D:
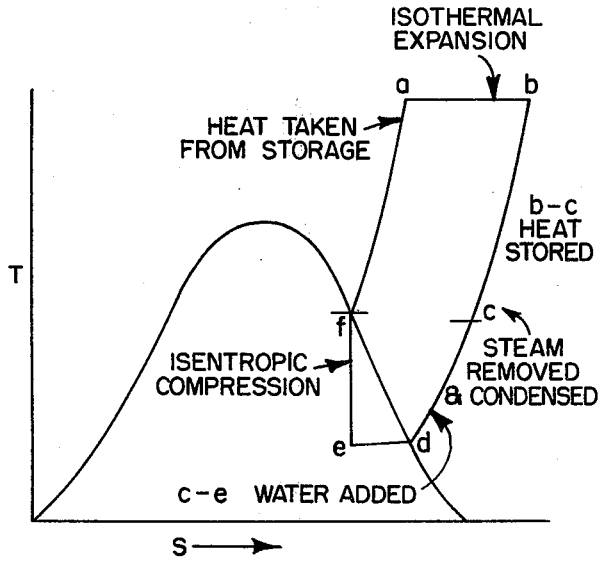

The ideal "steam-Stirling" engine with internal cooling is shown on the T—S and P—V plane in FIGS. 3*c* and 3*d*, together with similar diagrams for a permanent gas, FIGS. 3*a* and 3*b*.

Figure 4A:
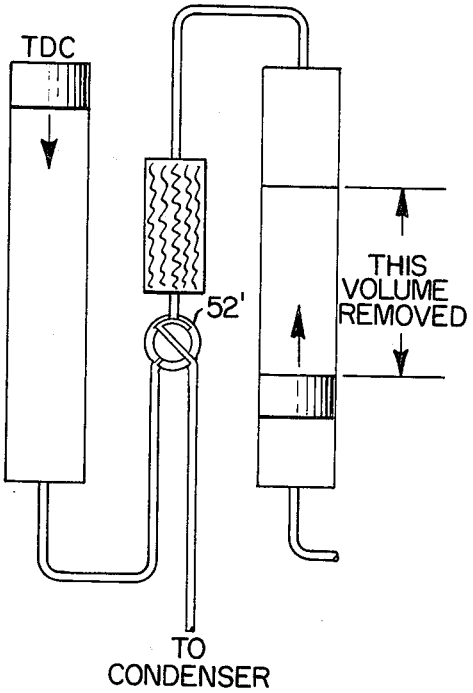
FIGS. 4*a* and 4*b* diagrammatically illustrate positions of a pair of pistons during steam condensation.
Figure 4B:
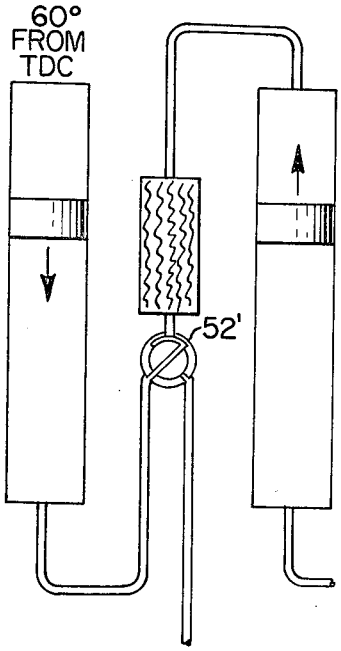

A portion of steam is removed and condensed. The point of removal is during passage from hot to cold space, after heat storage in the heat exchangers 42, 46 and 50. The corresponding point is C on the phase diagrams. The most favorable time to remove the steam, between a given pair of cylinders, is in the portion of the cycle depicted in FIG. 4*a* and 4*b*.

Figure 4C:
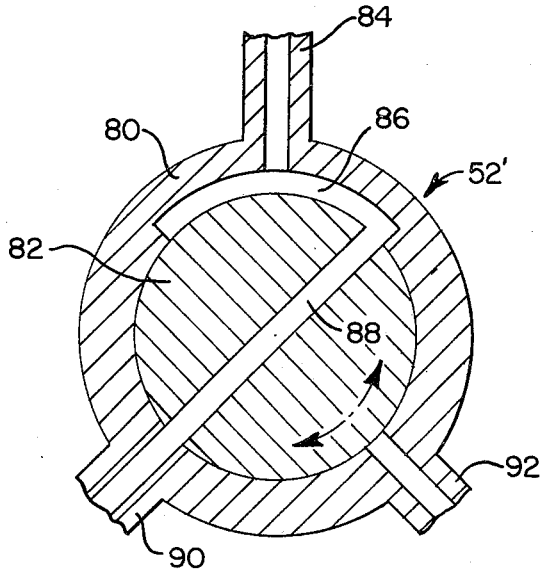
FIG. 4*c* diagrammatically illustrates an oscillating type steam regulating valve.

Referring particularly to FIG. 4*c*, a suitable oscillating type valve useable for directing a portion of the steam to the condensers and a portion to the cold part of the cylinders, as generally indicated at 52*a*, 52*b* and 52*c* in FIG. 1 of the drawing, is shown schematically at 52'. The oscillating valve includes a housing 80 and an oscillating rotor 82 having a diametrically transverse passage 88, and driven in an oscillatory motion by the crankshaft through a suitable mechanism which may be gears, sliders and cranks, cams or other means known to those versed in the art. Steam from a heat exchanger 42, 46 or 50 is directed via conduit 84 to valve chamber 86 and depending upon the position of internal passage 88, the steam is either directed to outlet conduit 90 having connections to one of the cold spaces of one of the cylinders 12*a*, 12*b* or 12*c* or to the condenser 38 via conduit 92.

The diagram shows that a simple oscillating or alternatively a rotary valve would have a reasonable crank interval for operation.

As hereinbefore indicated, an important feature of this system of the invention is that compression in the hot space is significantly decreased as the pressure during the "removal" stage is virtually constant, at or close to the minimum pressure in the system. In the interval of steam removal, all compression is confined to the cold end of the cylinder pair and the compression approaches isentropic.

INJECTION OF WATER

Figure 5A:
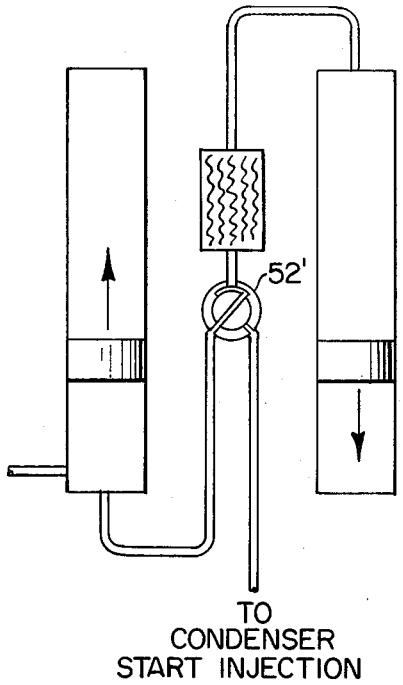
FIGS. 5*a* and 5*b* schematically illustrate water injection into the cold cylinder space.
Figure 5B:
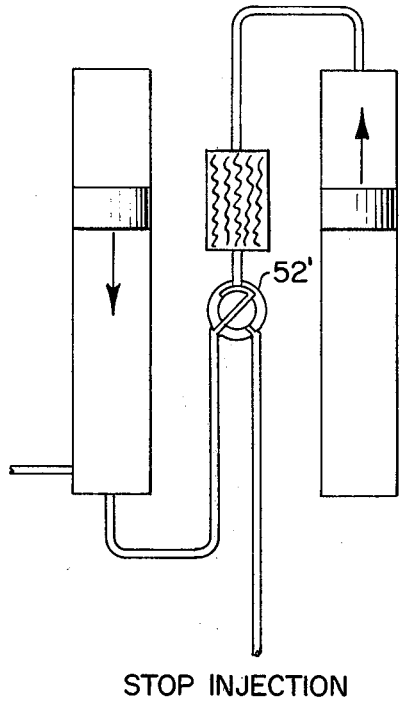

Injection should take place over 180° during the portion of the cycle shown in FIGS. 5*a* and 5*b*. The long crank interval allows use of an eccentrically operated plunger pump 30 described and claimed in U.S. patent application Ser. No. 503,929 filed Sept. 5, 1974.

The total crank interval from start of injection in any given cylinder to maximum compression is about 270°.

IDEAL EFFICIENCY-STEAM-STIRLING CYCLE VS STIRLING WITH PERMANENT GAS WORKING FLUID

The Stirling engine has "Carnot" or maximum theoretical efficiency between given temperature limits. Any other practical cycle (except, the Ericsson cycle) has to have lower ideal efficiency. The T-S diagrams in FIGS. 3*b* and 3*d* indicate the Vapor Stirling Cycle would have slightly lower ideal efficiency. The difference is scarcely significant as the following calculation shows.

Figure 6:
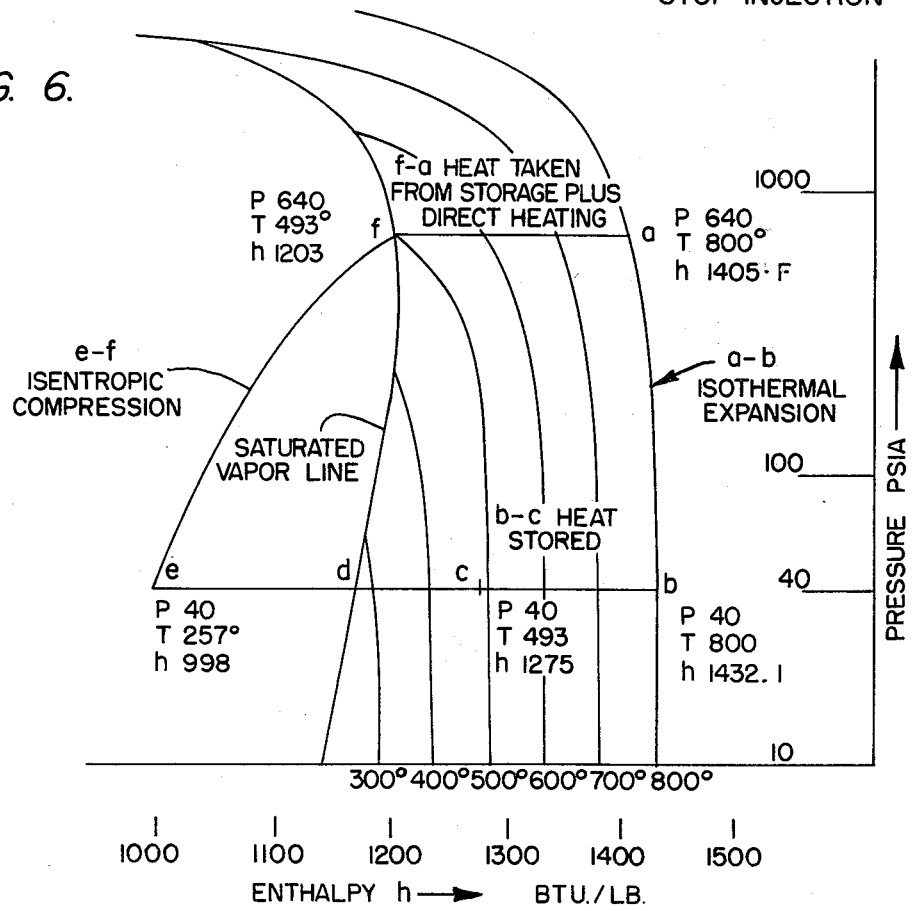
FIG. 6 is pressure-enthaply diagram associated with the Stirling cycle of the present invention.

A p-h diagram for steam showing the improved cycle is given in FIG. 6.

For the steam cycle:

For the steam cycle:

Isothermal work out per pound at $$800° = \frac{86 \times 1260}{778} \times 2.3 \log \frac{640}{40} = 386 \text{ BTU}$$

Isentropic Work of compression from *e* to *f* is

| | |
|---|---|
| 205 BTU | |
| Heat required: | |
| For isothermal expansion | 386 BTU |
| To increase enthalpy between *f* and *b* | +228.9 |
| | 614.9 |
| Taken from storage (*b* -*c*) | −157 |
| Total heat in per pound | 457.9 BTU |

(VAPOR STIRLING)

(Vapor Stirling)

$$\eta = \frac{386 - 205}{458} = 0.40$$

(GASEOUS STIRLING)

(Gaseous Stirling)

$$\eta = \frac{800 - 267}{800 + 460} = \frac{533}{1260} = 0.423$$

DEPARTURE FROM IDEAL BEHAVIOR — "WORK RATIO" OF STIRLING STEAM CYCLE AND STIRLING GASEOUS CYCLE

It has been shown earlier than the work of compression of the improved cycle is less than for the Stirling gas cycle.

The example above shows this clearly. The "work ratio" (ratio of work of compression to work of expansion) in the improved cycle is $$\frac{205}{386} = 0.53$$

Between the same temperature limits, the Stirling gas cycle has an ideal work ratio of $$\frac{460 + 267}{460 + 800} = 0.576$$

The difference is significant.

Figure 7:
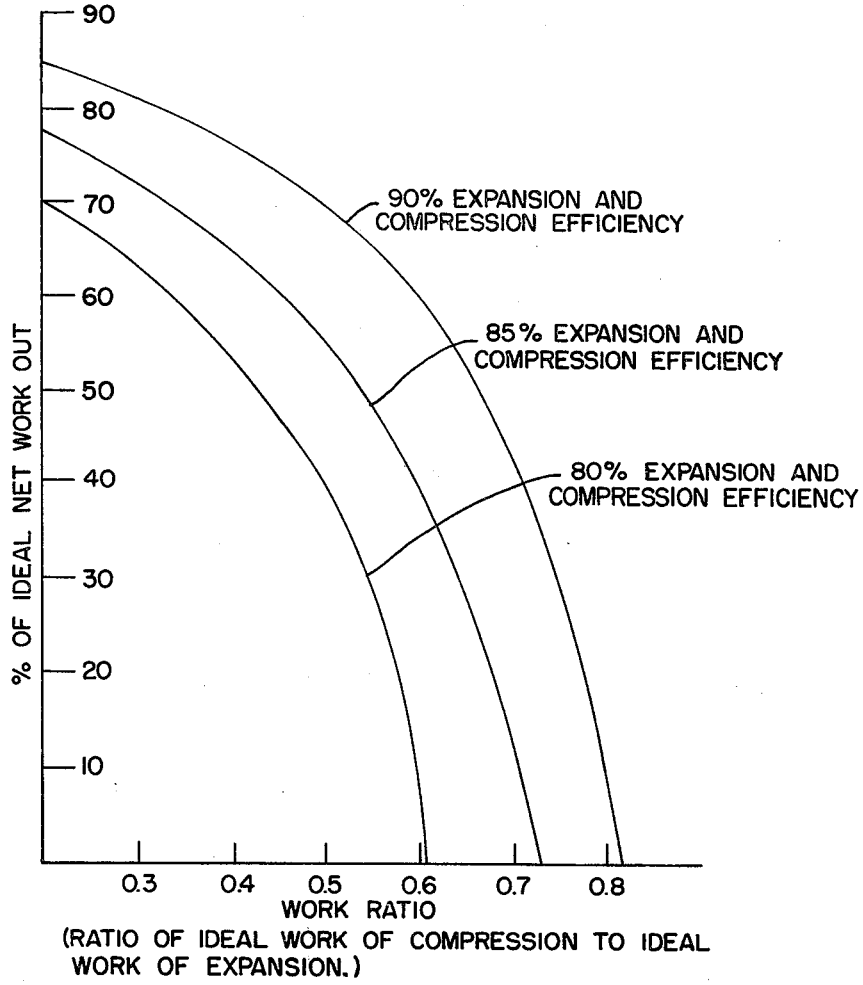
FIG. 7 is a diagram illustrating the percentage of ideal work produced, as a function of the ratio of work of compression to work or expansion, for various expansion and compression efficiencies.

A family of curves showing percent of ideal net work against work ratio is revealing and such a set of curves is shown in FIG. 7. At realizable expansion and compression efficiencies, the achievable percentage of ideal net work out falls off rapidly with increasing work ratio; small differences in the latter have a disproportionate effect on the real performance of the engine.

With respect to minimizing work ratio, the improved cycle has a number of distinct advantages, viz.

1. Lower "ideal" work ratio.
2. Internal cooling.
3. Less compression takes place at high temperature due to removal of steam for condensing.

These effects will more than offset the slightly greater ideal efficiency of the gas Stirling system.

HEAT INPUT

FIG. 1 shows diagrammatically the fire-tube boiler 16 for a condensable heat transfer medium. Dow-therm A or Therminol 88 with finned copper heater and finned cylinder head, or tetraphenyl silane with carbon steel, are suitable heat input mediums.

Another useful heat input medium for use in the present invention is elemental sulfur. With a melting point of 235° F, and boiling point of 920°F, its vapor pressure at 1022° F is only about 60 psia, and its critical temperature is 2132° F, which would permit its use as a condensing vapor at the highest temperatures set by materials of construction. It is, furthermore, cheap, abundant, light in weight, and readily available, and being an element, stable in the absence of air at all temperatures.

OTHER MECHANICAL FEATURES OF THE IMPROVED SYSTEM

In the valveless engine, the only significant loss of working fluid is around the piston rod seal. With gaseous working fluids, this has always been a problem, especially with hydrogen. A solution lies in the so-called roll-sock and the elaborate mechanism to equalize pressure across it by an oil-hydraulic system.

The negligible cost and ready availability of water eliminate the need for the roll-sock and loss of steam can be accepted.

CHANGE OF MASS OF WORKING FLUID — CHANGE OF POWER

As stated, use of vapor plus liquid injection provides a relatively simple means of varying the mass of working fluid in the power system. This replaces the gas storage vessel and compressor plus controls necessary to accommodate the power changes of the gaseous Stirling System. The gaseous compressor system like the roll-sock pressure equalizer, is not only complex, but is a continuous parasitic loss.

HEAT TRANSFER TO ENGINE WORKING FLUID

With the objective of approaching isothermal expansion of working fluid in hot cylinder, the present invention teaches the method of maximizing heat transfer rate to heater and cylinder head by heating with condensing vapor and further, to increase the surface area by finning the heater and the cylinders. Use of tapered pistons in the hot cylinders to increase heat transfer period and heat transfer surface through the cylinder walls can be advantageously employed.

Figure 8A:
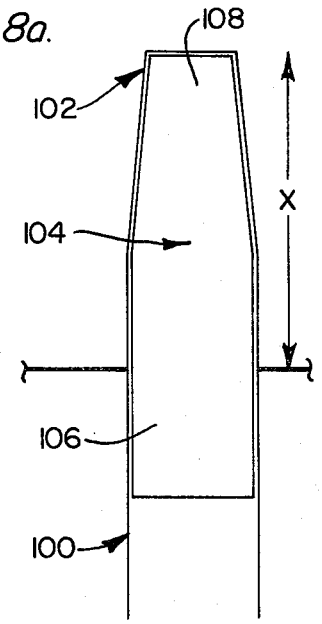
FIGS. 8*a* and 8*b* diagrammatically illustrate the affect of tapered pistons on heat transfer in the cycle.
Figure 8B:
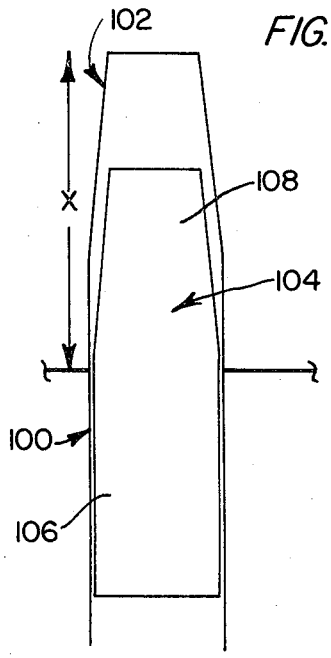

FIGS. 8*a* and 8*b* show how this would have two effects. The total heated surface of the cylinder is increased almost three-fold; and the whole heated surface is in contact with the working fluid throughout the whole stroke. The latter is especially important because of the slow initial movement of the piston.

Referring to FIGS. 8*a* and 8*b*, 100 generally denotes the cylinder of a condensable fluid Stirling cycle engine having the upper or hot portion of the cylinders designated 102 tapered substantially throughout the zone designated X to which heat is applied to the cylinders. The improvement also includes pistons 104 having cylindrical lower portions 106 and tapered upper portions 108. The tapers 108 correspond with the tapers of the upper portions of the cylinders 102.

EXAMPLE 1

Method of Calculation of Approximate Engine Swept Volume Per H.P. Work Ratio, Realizable and Ideal Efficiency

Assumptions

1. Maximum temperature in working fluid during expansion is 1000° F.
2. Maximum steam pressure 640.
3. Expansion to 40 psia.
4. Compression — from 40 to 640 psia within vapor dome. Isentropic compression; entropy of compression 1.44; steam at end of compression is dry saturated at 640 psia.

(See FIG. 6).

Ideal work of expansion is $$\frac{86 \times 1460}{778} \times 2.302 \log \frac{640}{40} = 452 \text{ BUT/lb.}$$

Ideal work of compression (FIG. 6) is 205 BTU/lb.

Ideal net work is 452 − 205 = 247 BTU/lb.

Ideal work ratio is 205/452 = 0.453

At 90% expansion and compression efficiency, the fraction of ideal net work realizable is 0.73 (FIG. 7).

Realizable net work is 0.73 × 247 − 180 BTU/lb.

At maximum volume, of (*a*) cubic foot, 1 lb. of steam will be divided approximately by volume as $$\text{Volume at } 1000° \frac{a \times 0.8}{1.8} \text{ c.f.}$$

$$\text{Volume at } 267° \frac{a \times 1.0}{1.8} \text{ c.f.}$$

Specific volume at 1000° & 40 psia is 22.84 cf/lb.

Specific volume of wet steam of quality 0.82 at 40 psia is 0.82 × 10.501 cf/lb.

Then: for 1 lb. of steam $$\frac{a \times \frac{1}{1.8}}{10.501 \times .82} + \frac{\frac{a \times 0.8}{1.8}}{22.84} = 1$$

Solving for a:

a = 11.93 c.f. per pound of steam

At 1000°, actual realization workout per pound of steam is 180 BTU.

Wt. steam required to produce 1 h.p. is 42.42/180 = 0.236 lbs/min.

Total maximum volume is then 11.93 × 0.236 cf/minute.

If *b* cubic inches is engine swept volume at 3600 r p m $$\frac{3600\, b}{1728} = \frac{11.93 \times .236}{1.8} \text{ cubic inches}$$

*b* = 0.75 cubic inches per horse power

At engine speed of 2700 RPM the system would produce 1 h.p. per cubic inch.

"Heat in" per pound of steam is:

| | |
|---|---|
| "Heat in" per pound of steam is: | |
| Heat for isothermal expansion - | 452 BTU |
| From Figure 6 [+ (Enthalpy at b - enthalpy at f)] | +72 BTU |
| [− (Enthalpy at b - enthalpy at c)] | |
| | 524 BTU |

Assume 90% boiler efficiency

Heat required 1 lb. of steam is 524/0.90 = 582

Realizable net work is 180 BTU/lb.

Efficiency $\eta$ = 180/582 = 0.309

Ideal Efficiency $\eta$ Ideal = 247/524 = 0.472

EXAMPLE 2

The present invention teaches the method of cooling vapor in the compression space, the cold space of the engine, by injection of liquid into vapor.

The quantity of steam, which is condensed, and the weight of water which is injected into the steam to produce the requisite amount of cooling to reduce the entropy of the resulting wet steam, to the design point of the cycle is determined as follows:

Referring to FIGS. 1 and 3*d* showing (the Temperature - Entropy diagram for steam-water using the presently described cycle); and to FIG. 6.

In FIGS. 3*d* and 6, the point *b* represents the state of steam in the hot cylinder at the end of expansion.

The state point of this expanded steam, from FIG. 6 is pressure $p = 40$ psia
Temperature T = 800° F
Enthalpy $h = 1432.1$ BTU 1 lb.

This steam is passed through heat exchangers 42, 46, 50 and cooled. It emerges from the heat exchanger having properties shown as state-point C of FIG. 3*d* and FIG. 6.

At this point, the valve 52*a*, 52*b* or 52*c* in FIG. 1 passes a portion of the steam in the hot cylinder to the condenser 38. The weight equivalent of the steam passed to the condenser is injected as a fine mist of water into the cold end of the adjacently connected cylinder through one of the injectors connected to pump 30.

Steam passed to the condenser at 40 psia will condense at 267°; enthalpy of condensate is: 236.16 BTU/lb.

For 1 pound of steam $x$ is amount of steam removed and condensed and $(1 - x)$ is amount remaining. $x$ is also the amount of condensate injected.

Steam from the hot cylinder passes through the heat exchangers 42, 46 or 50 of FIG. 1. The hot end of the heat exchanger is at maximum temperature; (in the present example, 800° F.) In passing through the heat exchanger, the steam is cooled to the saturation temperature corresponding to the maximum working pressure, — in the present example, 493°, (Point C in FIG. 3*d*, and Point C in FIG. 6.)

At the start of compression in the cold space, FIG. 6 shows the steam is required to have properties as shown at *e*, pressure $p = 40$ psia, enthalpy 998.

Then the amount of water $x$, required to make steam having state-point *e*, from steam at C, can be derived by solving for $x$ in the equation;

$$x(236.16) + (1 - x)\ 1275 = (1 - x + x)\ 998$$

$$1038.84\ x = 277$$

$$x = 0.266$$

In practice, in the example quoted, in each cycle 0.266 of the steam in the engine is removed after passage through the heat exchanger, condensed, and its weight equivalent is re-injected into the cold space of the engine.

In order to reduce power output of the engine, a larger amount of steam would be removed then re-injected and to increase power a greater amount of water would be injected than removed by condensation.

I claim:

1. A method of operating a Stirling cycle type engine comprising the steps:

A. directing a heated heat exchange fluid externally about the hot end of a cylinder of a Stirling cycle type engine and in indirect heat exchange with a condensible working fluid;

B. directing the heated vapor of the working fluid from the hot cylinder through a heat exchanger;

C. condensing a portion of the vapor after it has passed through the heat exchanger;

D. directing the remaining portion of the vapor to the cold cylinder space of the Stirling cycle type engine; and E. before and during compression of the vapor in the cold cylinder space injecting a liquid of the working fluid in an amount equal to, greater than or less than the portion condensed in step C.

2. The method of operating a Stirling cycle type engine as defined in claim 1 wherein the heat exchange fluid directed externally about the hot end of a cylinder of a Stirling cycle type engine and in indirect heat exchange with a condensible working fluid is selected from the group consisting of tetraphenyl silane; Dowtherm A; Therminol 88; and elemental sulphur.

3. The method of operating a Stirling cycle type engine comprising the steps defined in claim 1 wherein the working fluid comprises water.

4. The method of operating a Stirling cycle type engine as defined in claim 1 wherein the amount of liquid injected in step E is equal to the amount condensed in step C.

5. The method of operating a Stirling cycle type engine as defined in claim 1 wherein the amount of liquid injected in step E is greater than the amount condensed in step C.

6. The method of operating a Stirling cycle type engine as defined in claim 1 wherein the amount of liquid injected in step E is less than the amount condensed in step C.

7. A stirling cycle type power generating means comprising:

A. means directing a heated heat exchange fluid externally about a hot end of a cylinder of a Stirling cycle type engine and means for directing said heat exchange fluid in indirect heat exchange with a condensible working fluid;

B. means for directing the heated vapor of the working fluid from the hot cylinder space through a heat exchanger;

C. means for condensing a portion of the vapor after it has passed through the heat exchanger;

D. means for directing the remaining portion of the vapor to the cold cylinder space of the Stirling engine; and E. means for injecting a liquid of the working fluid in an amount equal to, greater than or less than the portion of the working fluid condensed in the condenser means during and/or before compression of the vapor in the cold cylinder space.

* * * * *